US010080464B2

(12) United States Patent
Daley

(10) Patent No.: US 10,080,464 B2
(45) Date of Patent: Sep. 25, 2018

(54) INFANT BATHER WITH FRONT DRAIN

(71) Applicant: BRICA, INC., Van Nuys, CA (US)

(72) Inventor: Richard A. Daley, Charlotte, NC (US)

(73) Assignee: Munchkin, Inc., Van Nuys, CA (US)

( * ) Notice: Subject to any disclaimer, the term of this patent is extended or adjusted under 35 U.S.C. 154(b) by 43 days.

(21) Appl. No.: 14/658,080

(22) Filed: Mar. 13, 2015

(65) Prior Publication Data

US 2015/0257609 A1 Sep. 17, 2015

Related U.S. Application Data

(63) Continuation-in-part of application No. 61/953,104, filed on Mar. 14, 2014.

(51) Int. Cl.
*A47K 3/12* (2006.01)
*A47K 3/074* (2006.01)

(52) U.S. Cl.
CPC ..... *A47K 3/127* (2013.01); *A47K 3/074* (2013.01)

(58) Field of Classification Search
CPC ..... A47K 3/127; A47K 3/074; A47K 3/064; A47K 3/07; A47K 3/164; A47K 3/024
USPC ..... 4/572.1, 586, 589, 590
See application file for complete search history.

(56) References Cited

U.S. PATENT DOCUMENTS 1,501,833 A * 7/1924 Amsel ..... A47K 3/074 4/551
1,802,147 A * 4/1931 Hansburg ..... A47K 3/164 4/586
2,089,801 A * 8/1937 Kennedy ..... A47K 3/127 4/572.1
2,487,228 A * 11/1949 Feichtmeir ..... A47K 3/074 4/586
2,504,287 A * 4/1950 Ward ..... A47K 3/127 4/572.1
2,644,953 A * 7/1953 Kennedy ..... A47K 3/064 4/572.1
2,724,839 A * 11/1955 Kennedy ..... A47K 3/164 4/551
3,248,741 A * 5/1966 Stout ..... A47K 3/064 222/78
3,633,222 A * 1/1972 Greenfield ..... A47K 3/127 297/452.14
5,361,430 A * 11/1994 Wise ..... A47K 3/024 4/572.1
5,809,588 A * 9/1998 Angelotti ..... A47K 3/064 4/572.1
5,926,866 A * 7/1999 Chao ..... A47K 3/024 4/572.1

(Continued)

*Primary Examiner* — Erin Deery
(74) *Attorney, Agent, or Firm* — Robert Z. Evora, Esq.; Christian Lek

(57) ABSTRACT

An infant bather having a top housing and a bottom housing detachably secured to the top housing. The top housing has a cradle with a first surface and a second surface and defines at least one aperture allowing a fluid to flow between the first surface of the cradle and the second surface of the cradle through the at least one aperture. The bottom housing has a basin with an interior surface and exterior surface. The second surface of the cradle coincides with the interior surface of the basin such that the fluid held within the basin submerges a portion of both the first and second surfaces of the cradle.

15 Claims, 25 Drawing Sheets

(56) References Cited

U.S. PATENT DOCUMENTS

| | | | | |
|---|---|---|---|---|
| 6,112,343 | A * | 9/2000 | Dixon | A47K 3/024 4/571.1 |
| 6,243,890 | B1 * | 6/2001 | Yang | A47K 3/024 4/572.1 |
| 6,578,209 | B2 * | 6/2003 | Lopes | A47K 3/024 4/572.1 |
| 7,533,425 | B2 * | 5/2009 | Monti | A47K 3/024 4/572.1 |
| 7,814,584 | B2 * | 10/2010 | Robles | A47K 3/074 4/545 |
| 8,250,683 | B2 * | 8/2012 | Richardson | A47K 3/024 4/571.1 |
| 8,607,375 | B2 * | 12/2013 | Yeung | A47K 3/064 4/585 |
| 9,149,160 | B2 * | 10/2015 | Liu | A47K 3/122 |
| 2004/0068788 | A1 | 4/2004 | Parson | |
| 2005/0268395 | A1 | 12/2005 | Parson | |
| 2007/0033730 | A1 | 2/2007 | Bean | |
| 2007/0074338 | A1 | 4/2007 | List | |
| 2007/0256233 | A1 | 11/2007 | Thorne | |
| 2007/0277305 | A1 | 12/2007 | Huang | |
| 2008/0127408 | A1 | 6/2008 | First | |
| 2008/0141452 | A1 | 6/2008 | Karbowski | |
| 2009/0126101 | A1 | 5/2009 | Le | |
| 2009/0158521 | A1 | 6/2009 | Richardson | |
| 2010/0180372 | A1 | 7/2010 | Ossi | |
| 2011/0010838 | A1 * | 1/2011 | Millner | A47K 3/164 4/592 |
| 2011/0023226 | A1 * | 2/2011 | Schwartz | A47K 3/034 4/572.1 |
| 2014/0201901 | A1 | 7/2014 | Gibree | |
| 2014/0325750 | A1 | 11/2014 | Anyika | |
| 2014/0338116 | A1 * | 11/2014 | Bloch | A47K 3/024 4/572.1 |
| 2014/0345042 | A1 * | 11/2014 | Morand | A47K 3/127 4/572.1 |
| 2014/0352053 | A1 | 12/2014 | Conohan | |
| 2015/0101118 | A1 | 4/2015 | Srour | |

* cited by examiner

INFANT BATHER WITH FRONT DRAIN

CROSS REFERENCE TO RELATED APPLICATIONS

This application claims priority to U.S. Provisional Application Ser. No. 61/953,104 filed Mar. 14, 2014; the contents of all of which are hereby incorporated by reference herein in their entirety into this disclosure.

TECHNICAL FIELD

The invention relates to the field of devices used for bathing infants in a reclining position.

BACKGROUND

Bathing an infant is a delicate task for any parent given that babies move around in the water, and a baby's skin becomes slippery when wet with soapy water and oils used for bathing infants. In earlier times, a parent had to hold an infant with one hand and wash the infant with the other hand to protect the baby from injury. This made the bathing process difficult for infants that are too young to sit up in a bath tub or wash basin on their own.

Over the years, parents have had the benefit of baby bath tubs that are shallow enough to prevent an infant from drowning, and some baby bath tubs have shapes that help hold an infant in a safe reclining position during bath time. Babies sit directly in their bath water in these prior art devices, so the parent uses the same bath water to wash and rinse the baby therein.

Some parents prefer to wash their baby in the sink or in a regular bath tub located in a standard bathroom. The basins in a household sink or bath tub are too deep for a reclining infant and present serious risk of drowning if the baby is unattended for even a moment. Babies, of course, move around during their baths, so the structures and surfaces in a sink or bath tub also present risks of bumps and bruises if the infant accidentally hits a hard surface with too much force. For these reasons, modern parents often utilize seats and recliners that may be positioned within a bath tub or sink to hold the baby in place while the parent finishes the bath. Even with these devices, however, bathing the baby requires the parent to reach down into a bath tub while in a kneeling position or stand over a crowded sink with a faucet obstructing the process.

The art of infant bathers, therefore, would benefit from a new design that secures the baby in a safe position relative to a basin of water, provides a convenient mechanism for the parent complete the bath, and ensures that the infant is in the healthiest environment possible for bathing.

SUMMARY

An infant bather comprising a top portion having a cradle and a bottom portion having a basin detachably secured to the top portion. The cradle has a first radius of curvature and defines at least one aperture. The at least one aperture may be a series of holes that drain fluid between the cradle and the basin. The basin has a second radius of curvature and an overflow point defining a fluid threshold. The cradle extends sufficiently into the basin such that the fluid threshold lies above a lowest portion of the cradle.

DETAILED DESCRIPTION

The infant bather disclosed herein addresses numerous problems associated with infant bathing devices of the prior art. In particular, the infant bather (10) shown in FIGS. 1-31 provides a basin (25) in which bath water of a known temperature and depth may be used to bath the baby, and the bather (10) allows for the parent to pour water, or other bathing solutions, over the baby without any fear of increasing the water level to a dangerous depth. Proper drainage is provided through the device to ensure that the baby remains in a safe environment during bath time.

Figure 1:
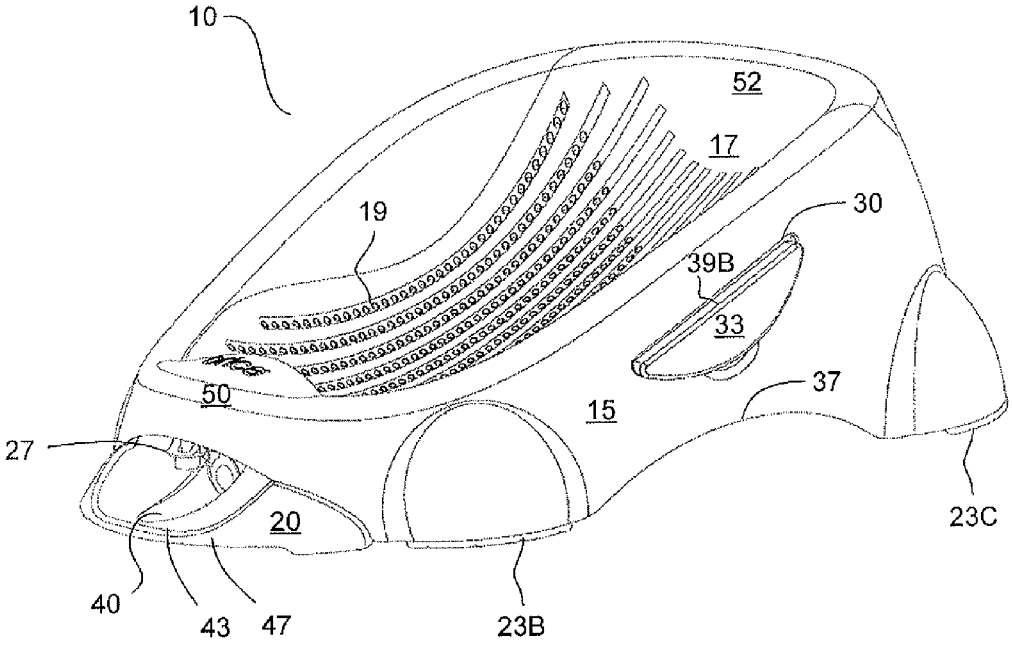
FIG. 1 is a side perspective view of an infant bather as disclosed herein.

Beginning with FIG. 1 (and further exemplified by FIGS. 8, 18-21 and 24-27), the infant bather (10) is assembled with a top housing (15) secured to a bottom housing (20), and the housings (15, 20) are separable for cleaning and storage. The top housing (15) defines a sling, or cradle (17), in which a child reclines with the child's head leaning against an elevated curvature (52) of the cradle (17) and the child's legs and feet generally straddling a lower mount (50) that prevents the child from sliding downward out of the bather (10). The elevated curvature (52) may be lined with a cushioning material, such as but not limited to a thermoplastic rubber (TPR) material, creating a soft head rest for the child. In the general corner areas of the bather (10), the body of the top housing (15) flares outwardly, creating pod-like stabilizers (24A, 24B, 24C, 24D) to which feet (23A, 23B, 23C, 23D) attach.

The cradle (17) on which the infant rests for bathing includes an appropriate curvature to extend the cradle (17) into a wash basin (25) defined within the bottom housing (20) of the bather (10). The cradle (17) extends sufficiently into the depth of the wash basin (25) so that an infant reclining within the bather (10) is exposed to an Fluid may flow freely between the cradle (17) and the basin (25) through the at least one aperture (19).

Figure 3:
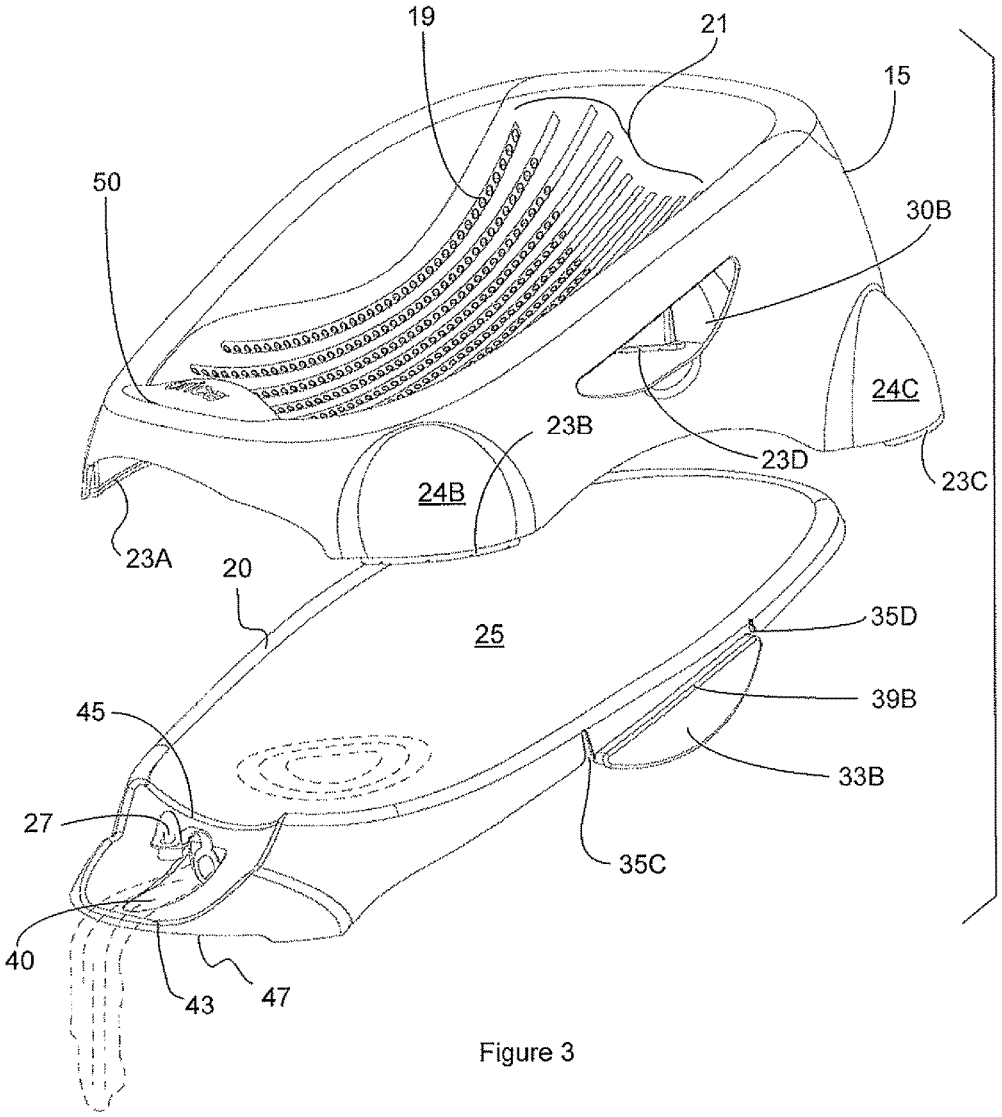
FIG. 3 is an exploded right side view of the infant bather with water in the basin draining from a front drain plug.

The bottom housing (20) incorporates a front side basin edge (45) that serves as an overflow point, ensuring a maximum depth of bath water in the basin (25). With this overflow point on the front side basin edge (45), a parent can add fresh water, such as rinse water, over the baby, and that fresh water drains into the basin (25) via the channels (21) and holes (19) defined by the cradle (17) of the top housing (15). The bottom housing (20), furthermore, defines a sloped outlet (40) allowing water running over the overflow point (42) to leave the bather (10) as illustrated in FIG. 3. When the bath is complete, the parent can open a plug (27) that fits into a corresponding basin opening (28) to drain the basin (25) all together.

Figure 4:
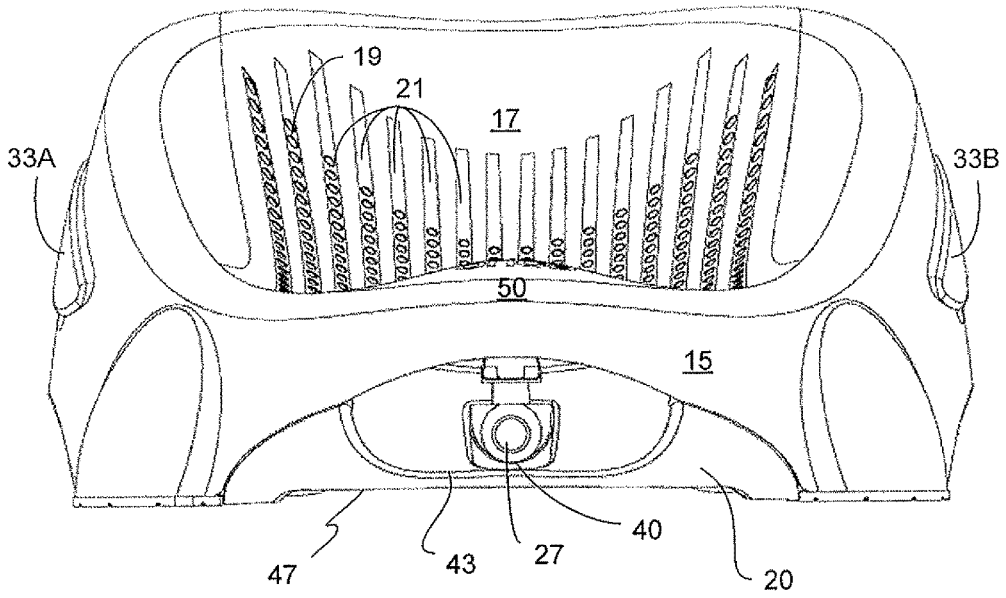
FIG. 4 is a front plan view of the infant bather.
Figure 5:
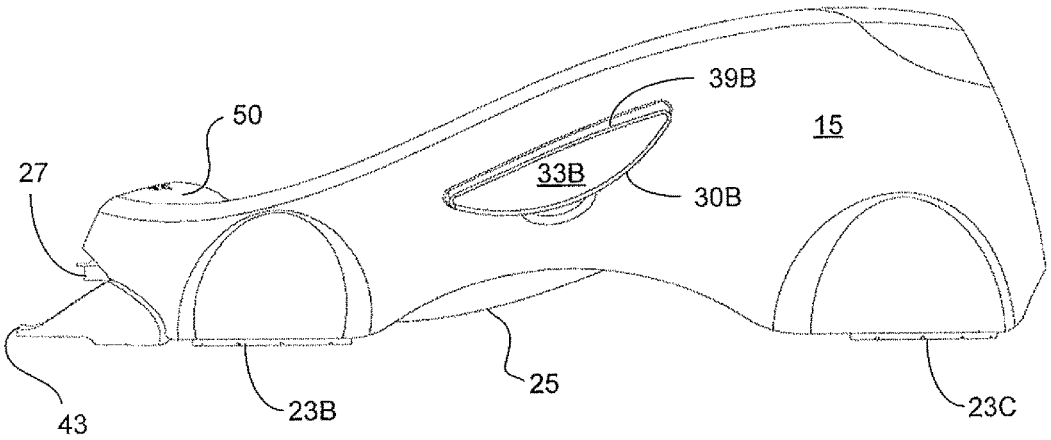
FIG. 5 is a right side elevation view of the infant bather.
Figure 6:
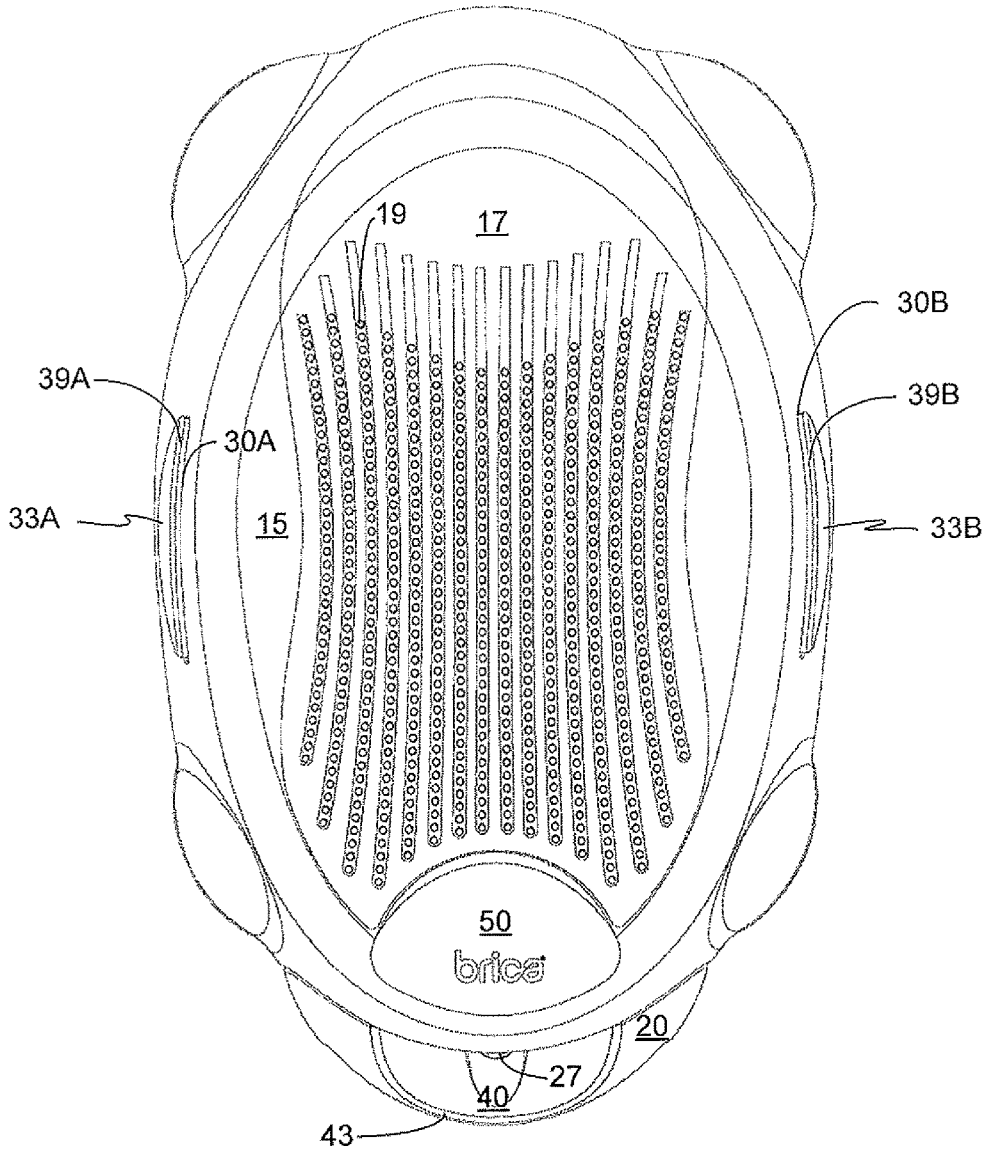
FIG. 6 is top side plan view of the infant bather.

The bather (10) is characterized in part by the front end of the bather shown most clearly in FIG. 4 (and further exemplified by FIGS. 5, 9-10 and 13-16). The front end of the bather (10) allows for water to drain down the sloped outlet (40) such that the bather can be used on a countertop and allowed to drain into a standard sink in either a kitchen or bathroom. As illustrated in FIG. 4, a front lip (43) of the bather (10) is elevated over the level of the feet (23) stabilizing the bather (10) so that the bather (10) define a generally parabolic front channel edge (47). The front channel edge (47) may be sized to fit against a sink edge, thereby seating the bather (10) against a sink and forming a convenient drainage point for water used during the baby's bath.

In one embodiment, the bather (10) conveniently comes apart because it has the above noted two piece construction. The top housing (15) and the detachably secured bottom housing (20) adjoin so that the infant in the cradle (17) is exposed to appropriate and controlled level of bath water in the basin (25) as shown in FIG. 3. A radius of curvature or a first concave curvature of the cradle (17) coincides with a radius of curvature or a second concave curvature of the wash basin (25) to the appropriate extent allowing the parent to know the exact depth of the bath water in which the baby is lying safely. The first concave curvature may be substantially congruent to, juxtaposed to, and/or side-by-side with the second concave curvature such that the cradle and basin are spaced apart by an approximately constant distance across each curvature in a substantially curved parallel formation. At least one aperture or a series of holes (19) defined by the cradle (17) allow the bath water to surround a portion of the baby that is safe for the baby to recline therein.

Figure 2:
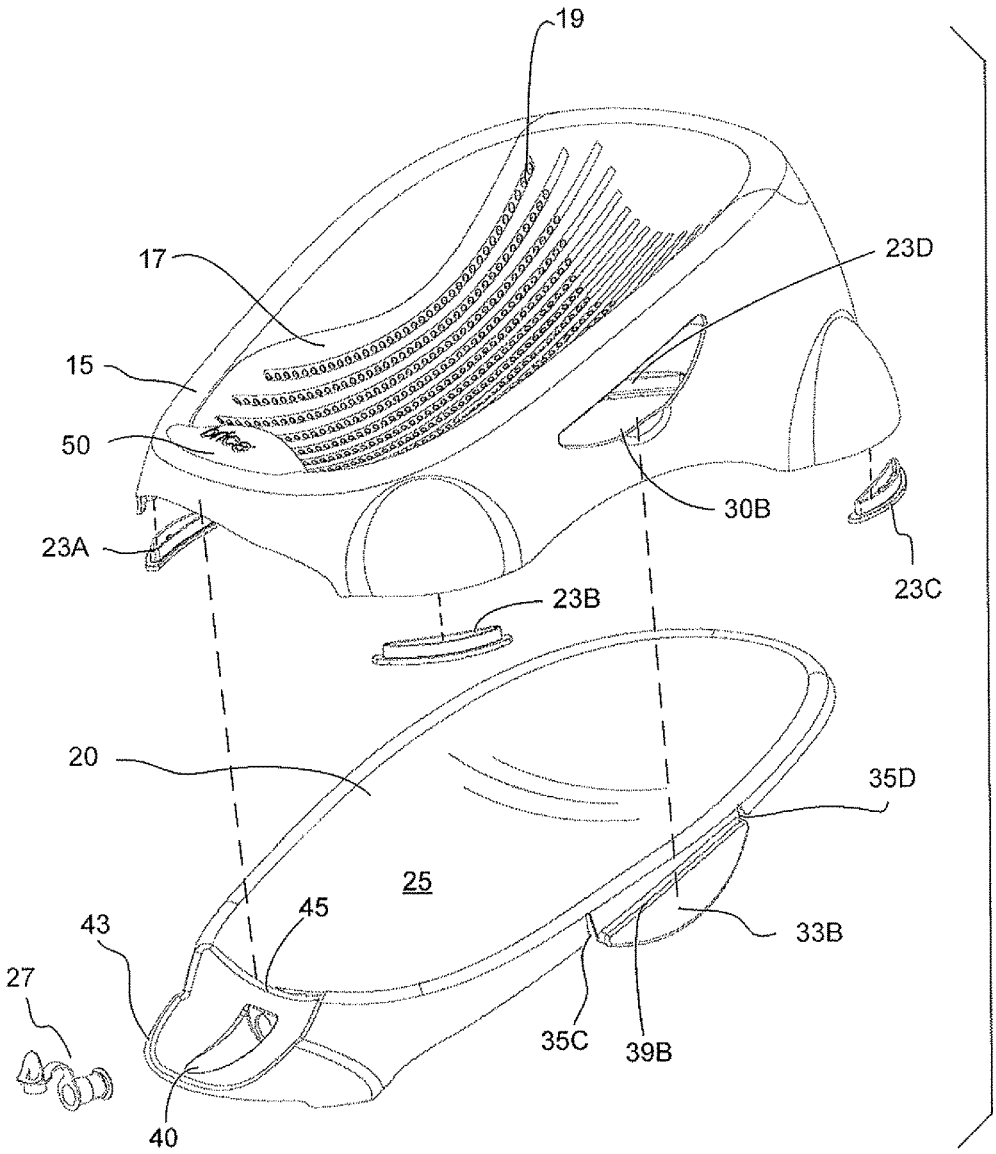
FIG. 2 is an exploded right side view of the infant bather.

The cradle (17) defines the series of holes (19) to expose the water in the basin (25) below the cradle (17) and to allow the parent or care giver to pour fresh water, such as warm rinse water, over a bathing baby without increasing the overall depth of the bath water. This process is possible because the cradle (17) also defines elongated channels (21) running along the pattern of holes (19) allowing for drainage through the cradle (17) into the wash basin (25). FIGS. 2 and 3 (and further exemplified by FIGS. 11-12 and 17) illustrate features of the bottom housing (20) and the wash basin (25) that ensure a constant bath water level, or a fluid threshold, in the device even when draining water from the channels (21) is added to water in the basin (25). While the bath water level is at the fluid threshold, a lowest portion (18) of the cradle (17) will be submerged within the fluid thereby allowing the infant to rest in a safe amount of bath water that lies above the lowest point (18) and below the fluid threshold. water in the basin (25). One embodiment of the bather (10), which does not limit the invention, attaches the top housing (15) and the bottom housing (20) with flexible tabs (33) formed into the structure of the bottom housing (20). Slits (35A, 35B, 35C, 35D) allow the tabs a predefined range of motion. The tabs (33A, 33B) mate with side openings (30A, 30B) defined in the top housing (15). Pressing, bending, or otherwise deflecting the tabs (33A, 33B) inwardly, or in a first direction, releases the top and bottom housing from engagement. The tabs (33A, 33B) each have an extended edge (39A, 39B) that secure respective tabs to the proper side openings.

Figure 7:
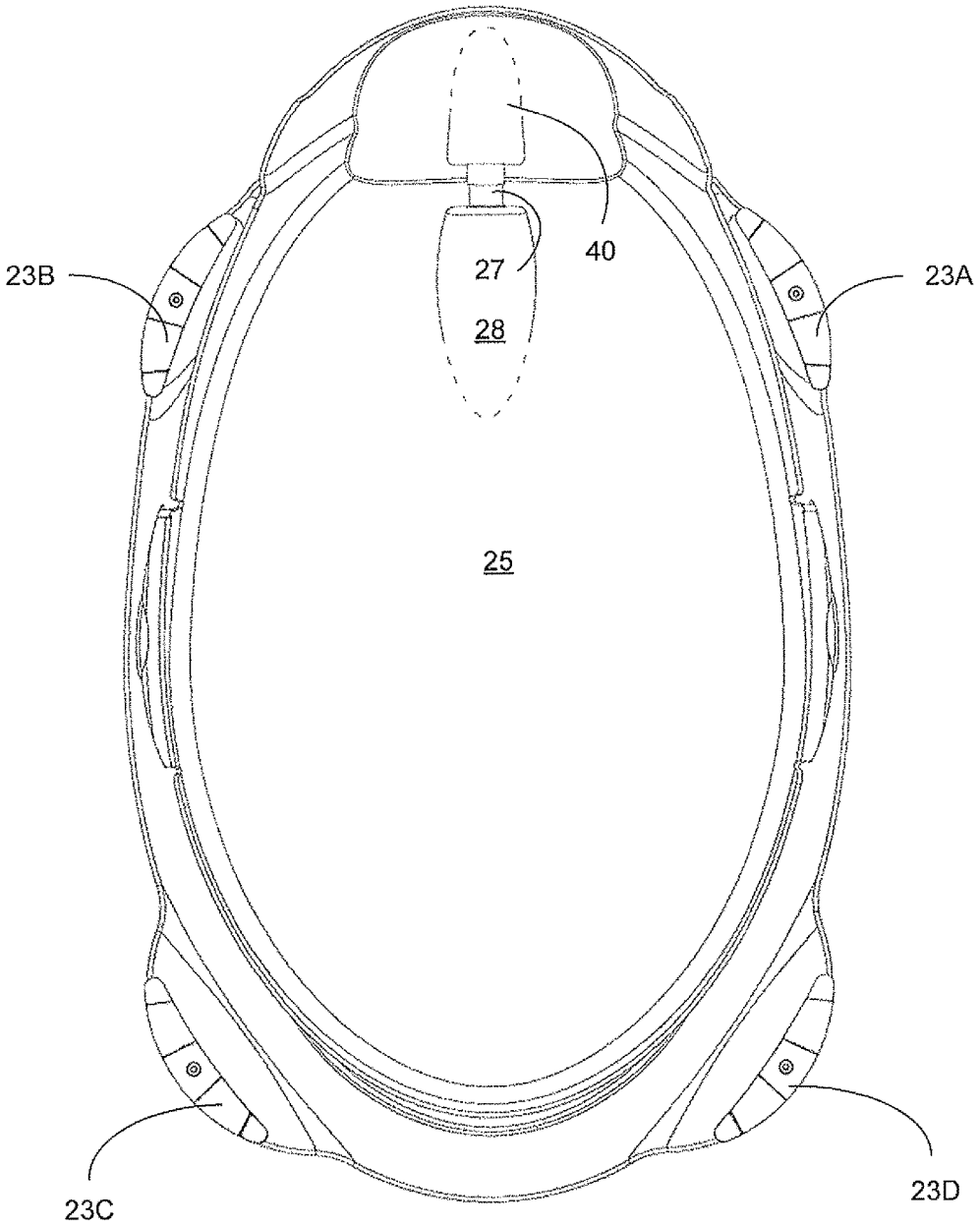
FIG. 7 is a bottom side plan view of the infant bather.
Figure 8:
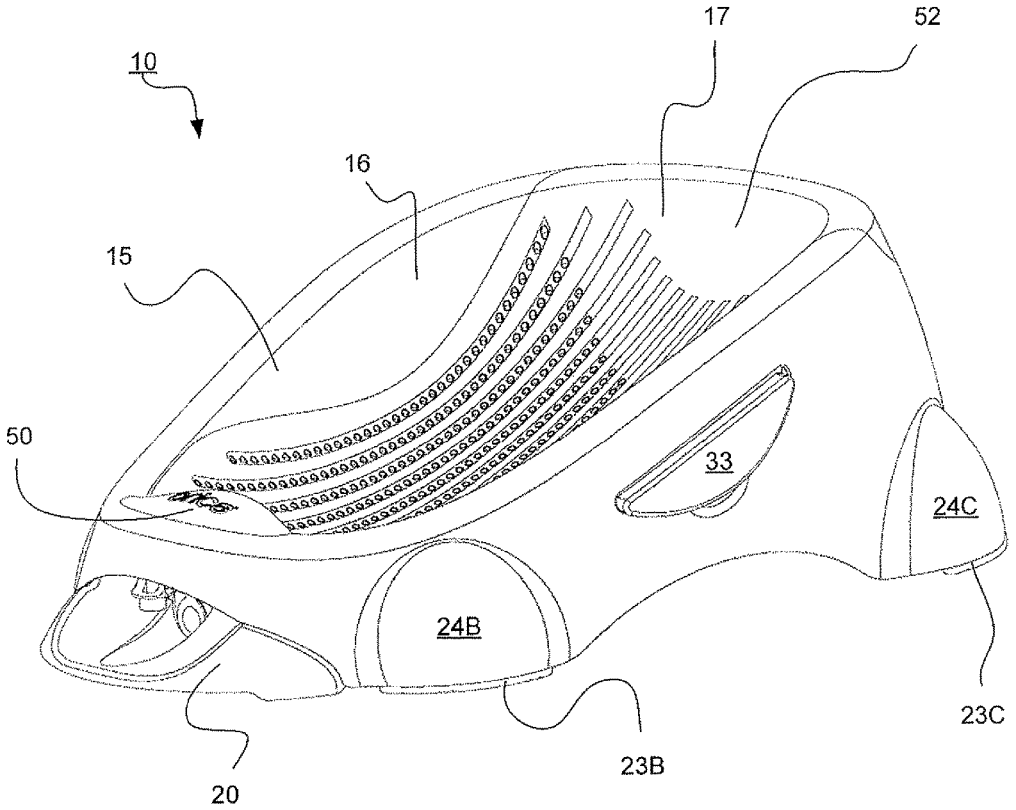
FIG. 8 depicts a side perspective view of an alternative embodiment of the infant bather.
Figure 9:
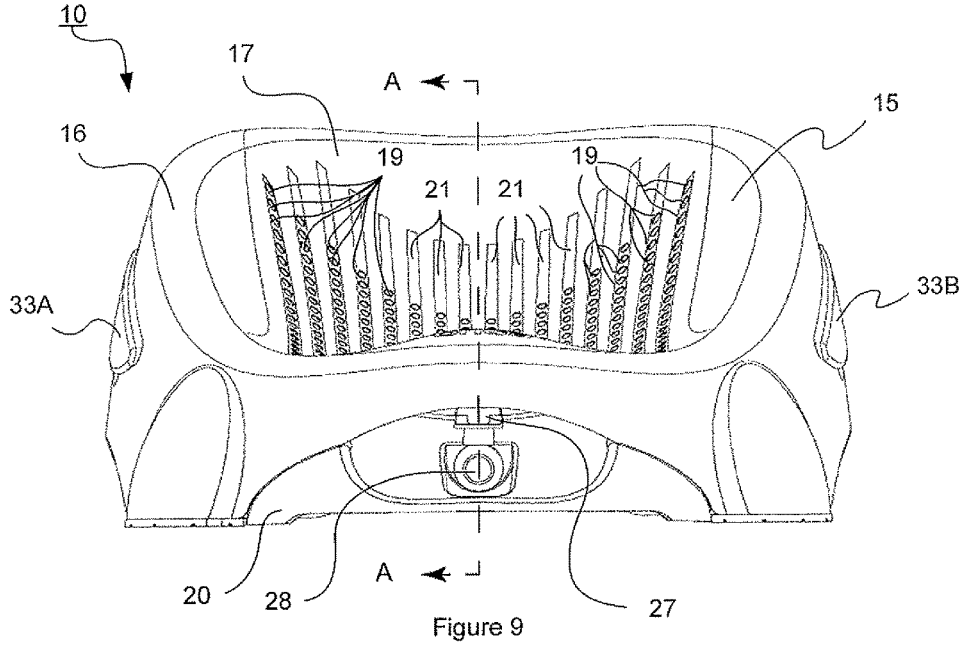
FIG. 9 is a front plan view of the infant bather.
Figure 10:
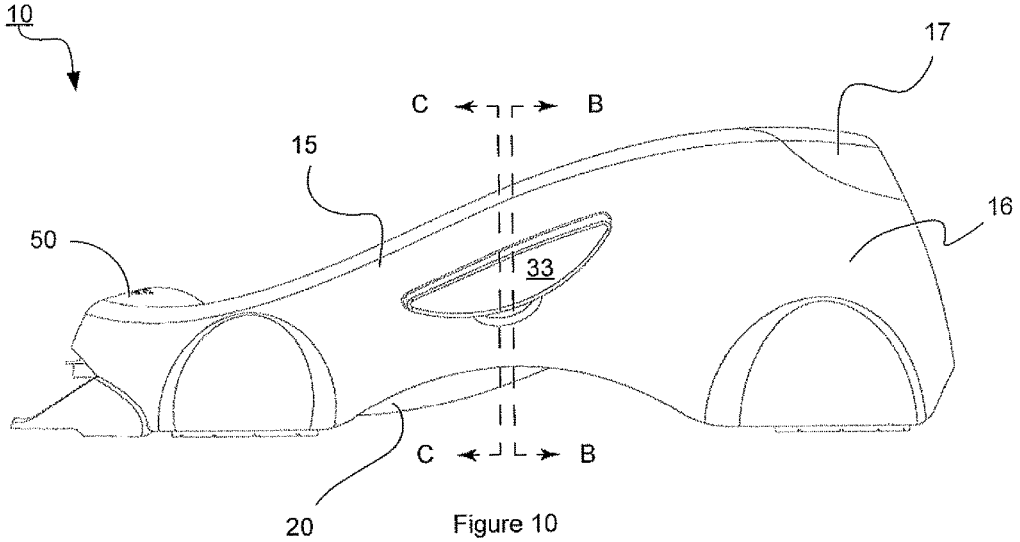
FIG. 10 is a right side elevation view of the infant bather.
Figure 11:
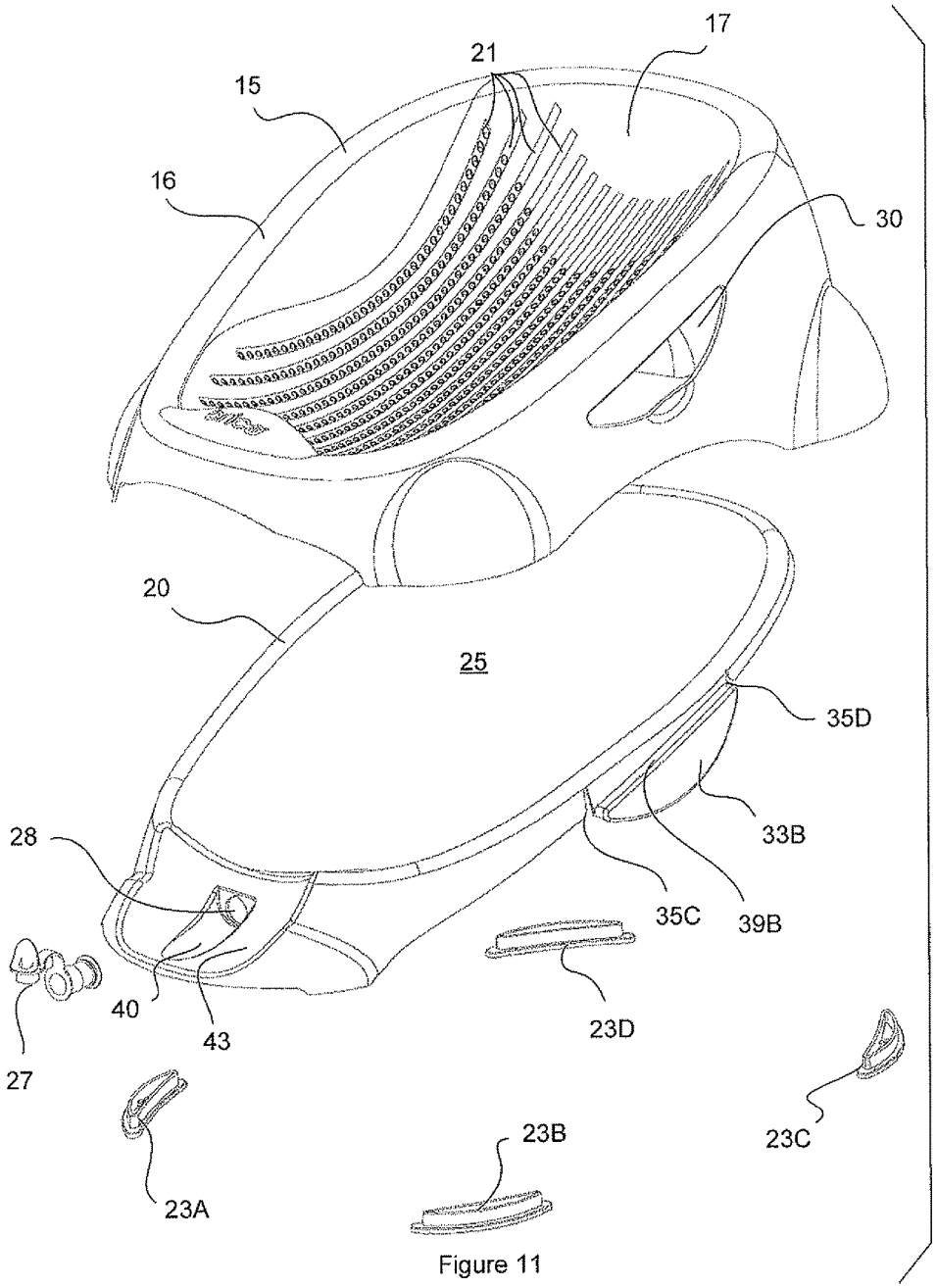
FIG. 11 is an exploded front side perspective view of the infant bather.
Figure 12:
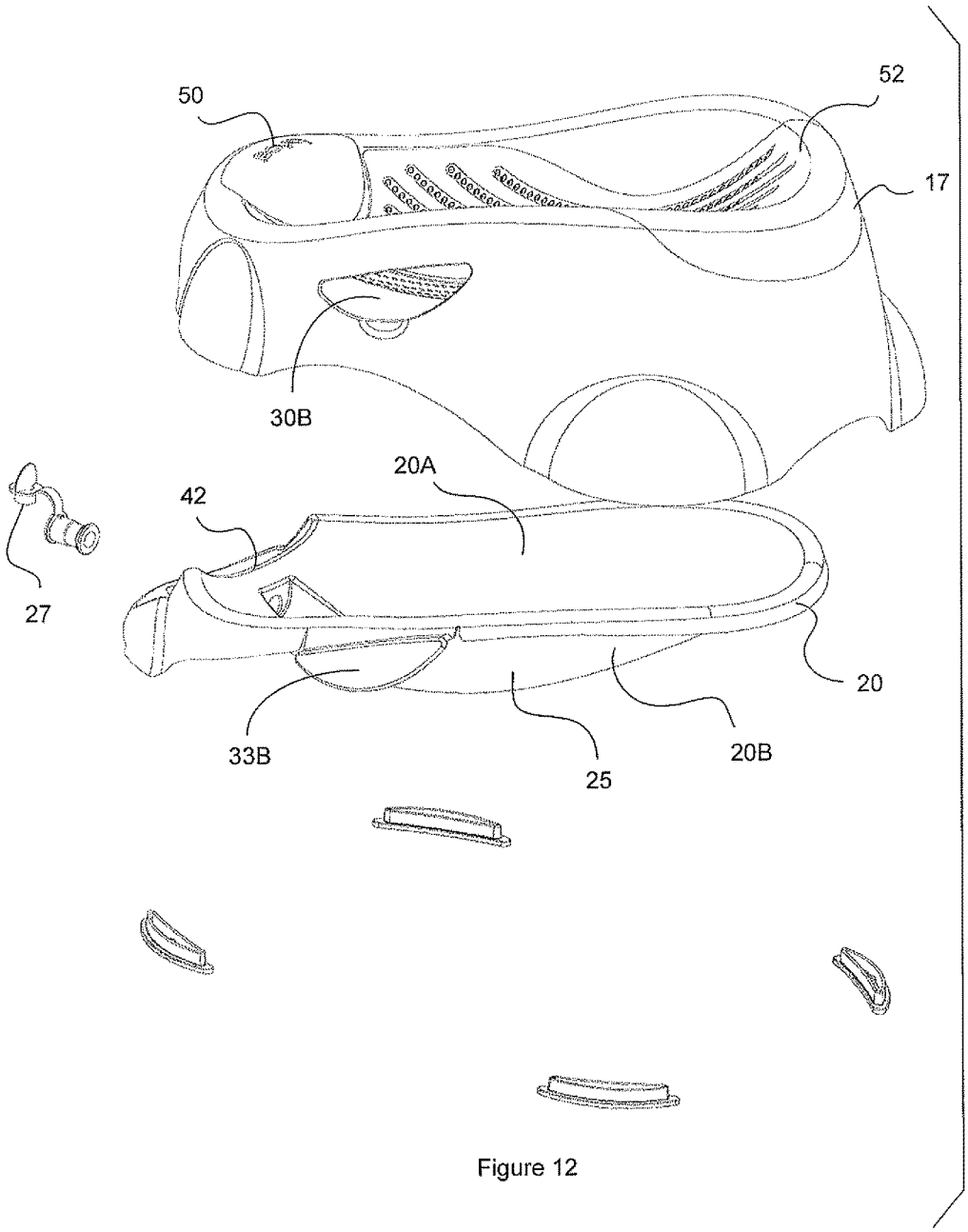
FIG. 12 is an exploded rear side perspective view of the infant bather.

FIG. 7 (and further exemplified by FIGS. 22 and 23) illustrates a bottom view of the bather (10) and shows numerous contours, such as the drain port (28) diverting the bath water toward the basin opening and plug (27). FIG. 7 further illustrates that the feet (23) of the bather (10) may define grooves or pads that stabilize the bather on a countertop during use.

FIG. 8-27 depict the top housing may be made from a frame (16) and cradle (17). The frame (16) may be made from a first material and the cradle (17) may be made from a second material. The first material of the frame (16) may have a different hardness from the second material of the cradle (17). The second material may be made from a softer, rubber or plastic material suitable for resting an infant upon during bathing. The first material may be made from a more rigid material for structural support. The cradle (17) may be comolded onto the frame (16), or bonded along a contiguous boundary (22) using any method of attachment.

Figure 13:
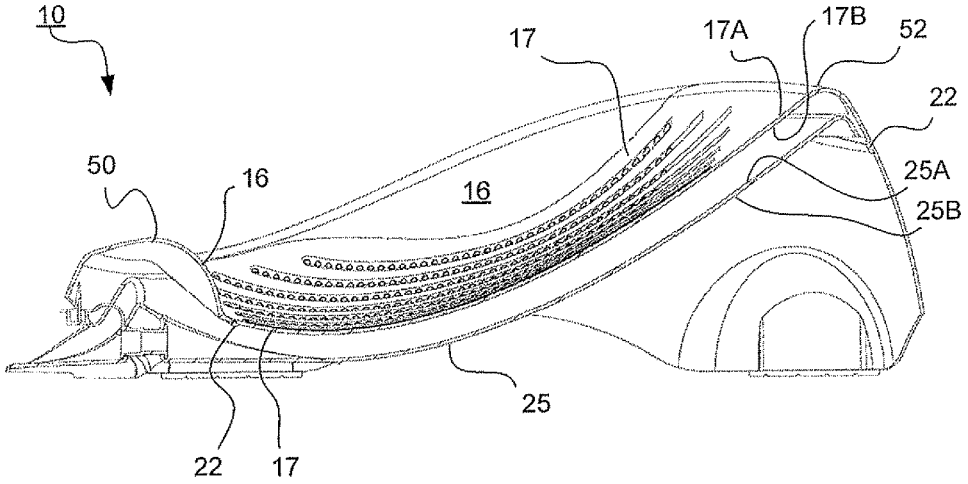
FIG. 13 illustrates a cross section view about line A-A in FIG. 9.
Figure 14:
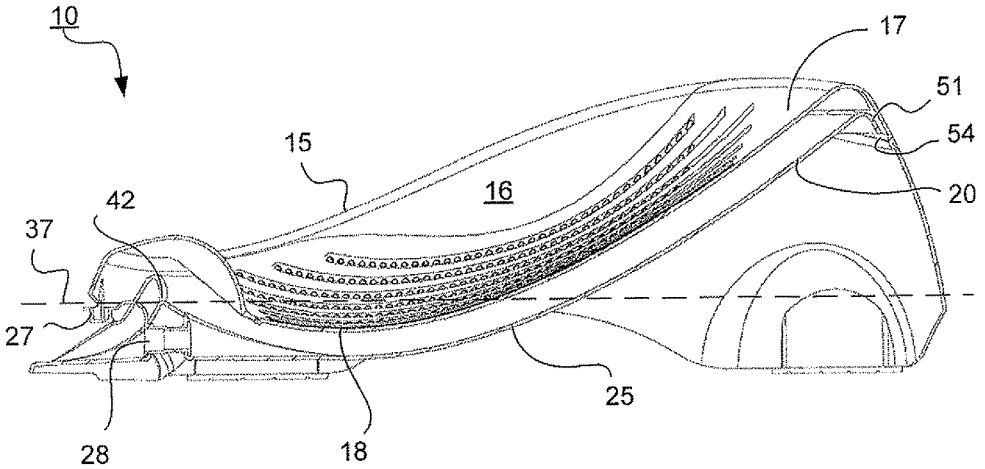
FIG. 14 shows a cross section view of an adjustment to the infant bather.
Figure 15:
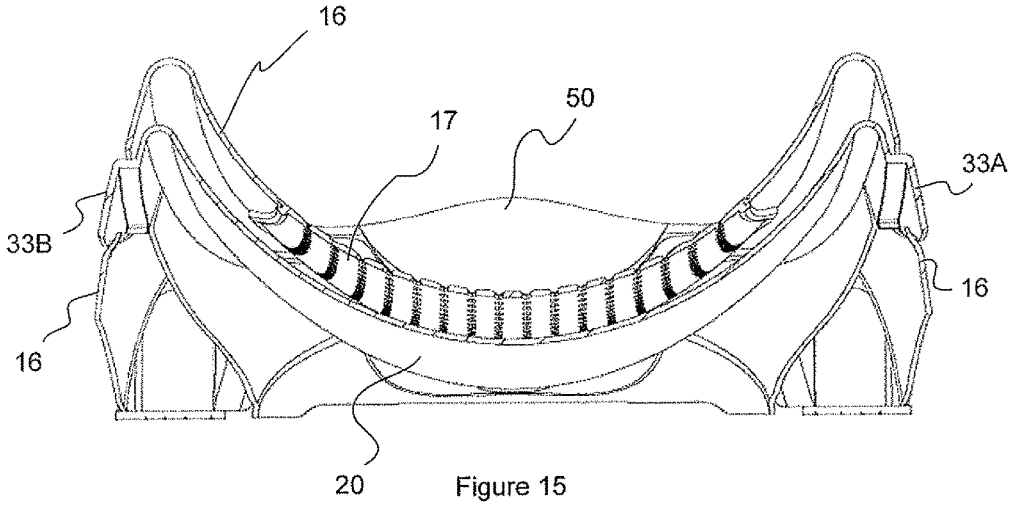
FIG. 15 depicts a rear facing cross section view about line B-B in FIG. 10.
Figure 16:
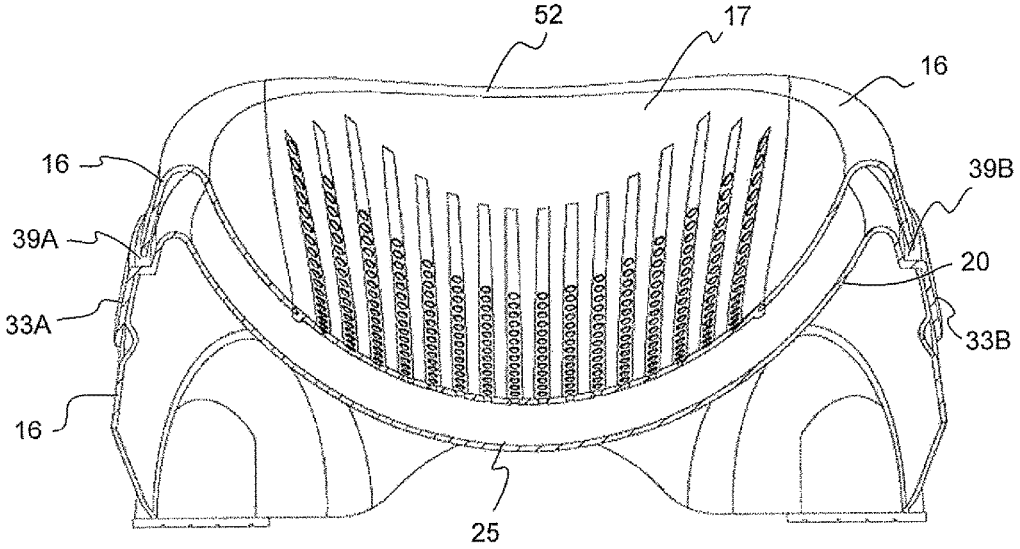
FIG. 16 illustrates a front facing cross section view about line C-C in FIG. 10.
Figure 17:
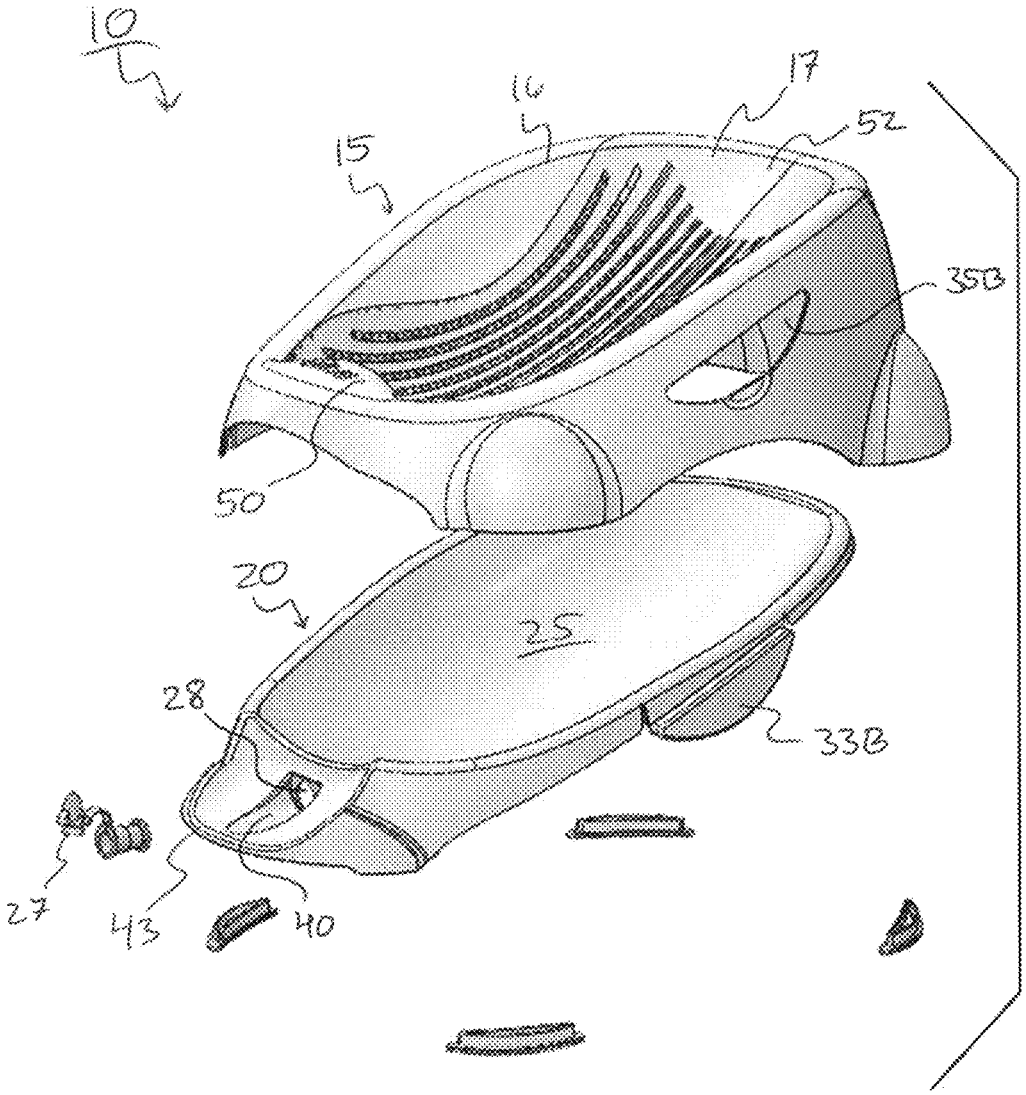
FIG. 17 shows an exploded side perspective view of the infant bather.
Figure 18:
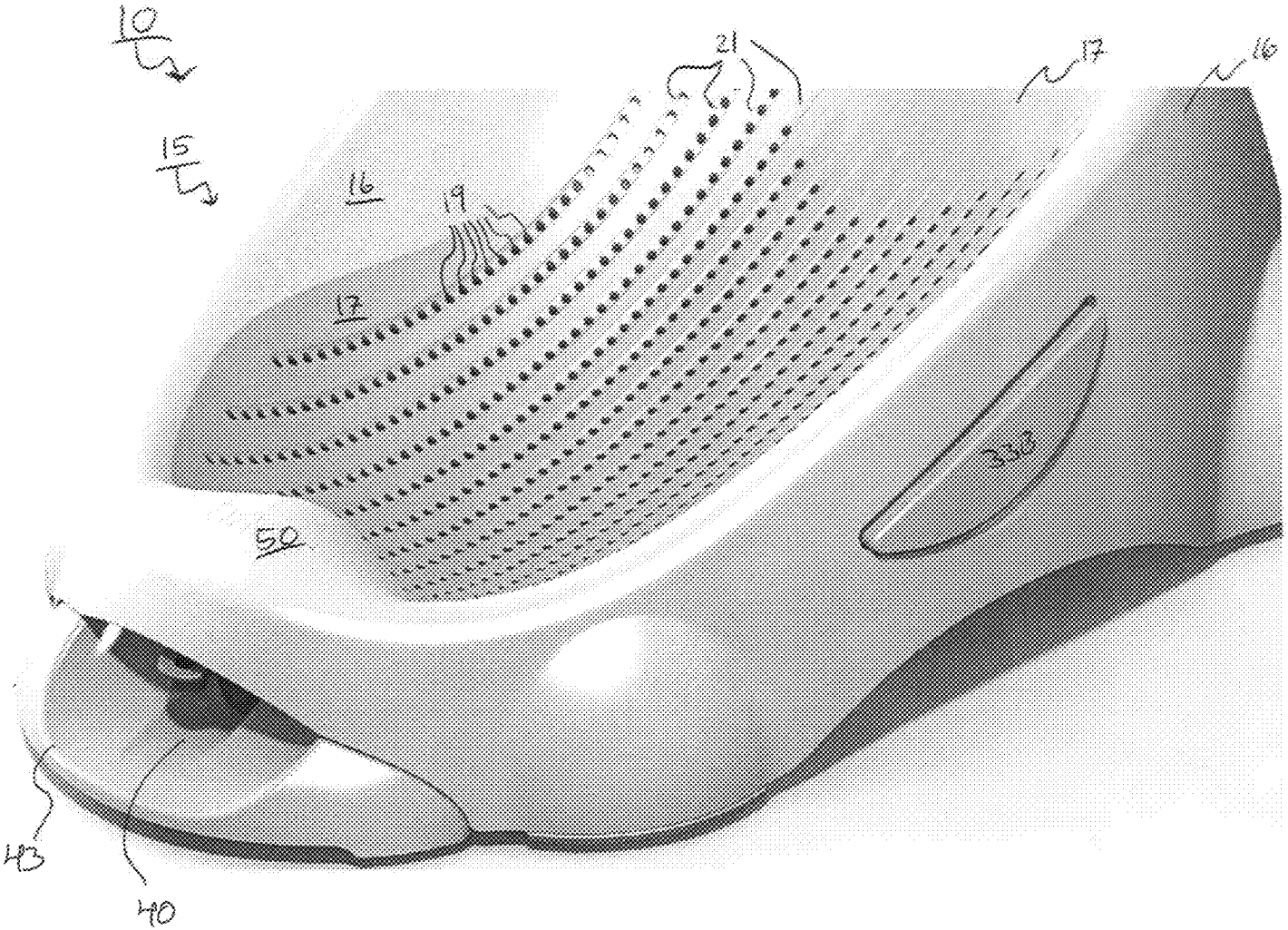
FIG. 18 is an enlarged side perspective view of the infant bather.
Figure 19:
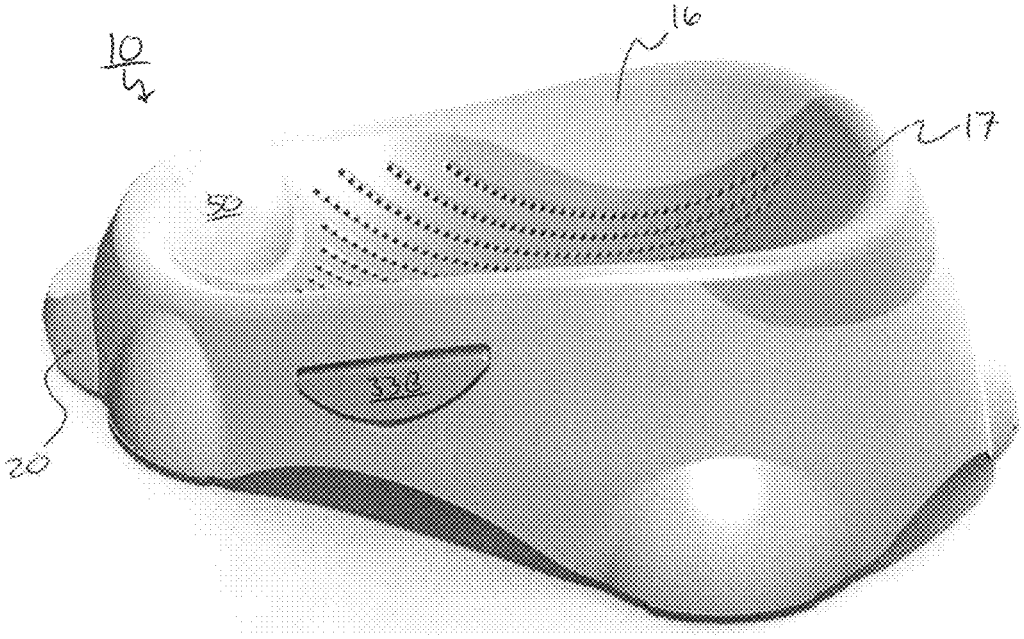
FIGS. 19-21 depict various rear side perspective views of the infant bather.
Figure 20:
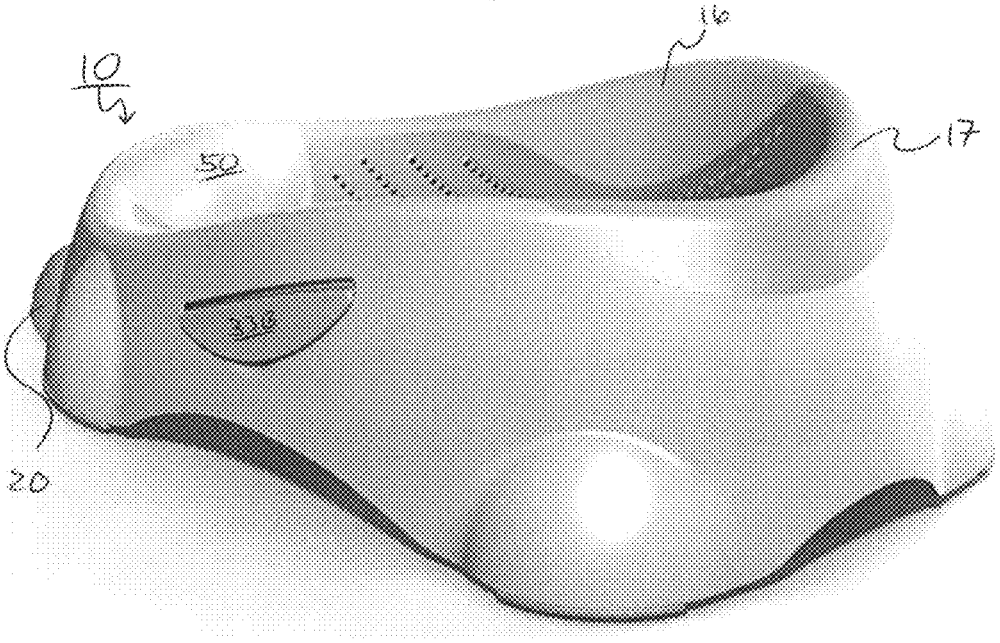
Figure 21:
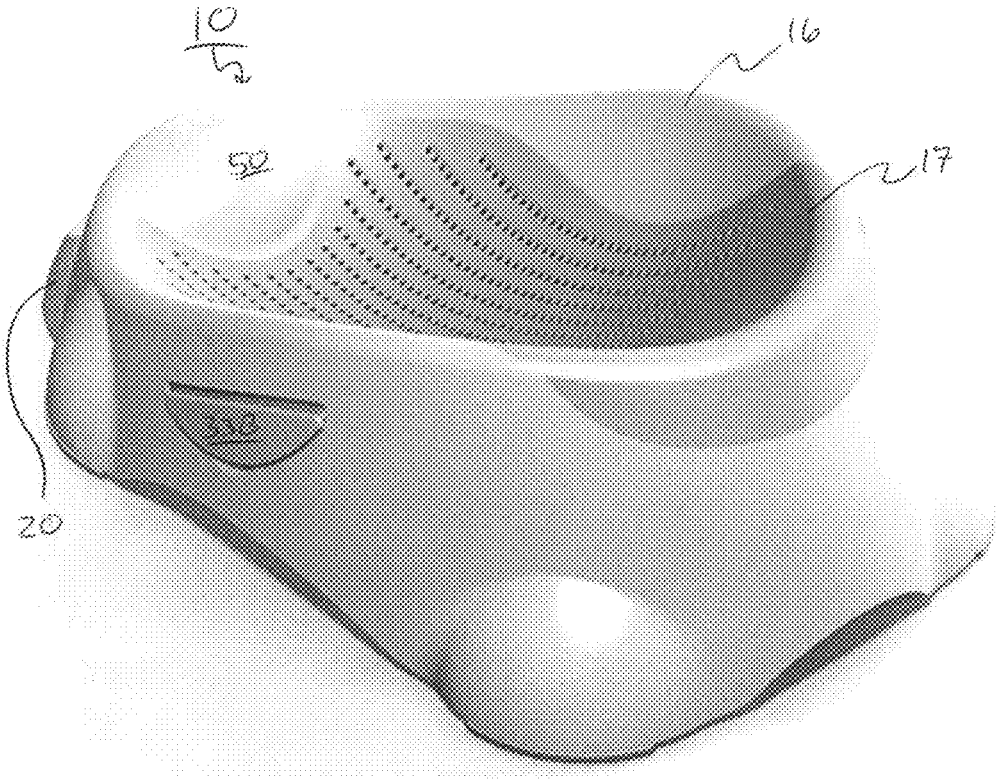
Figure 22:
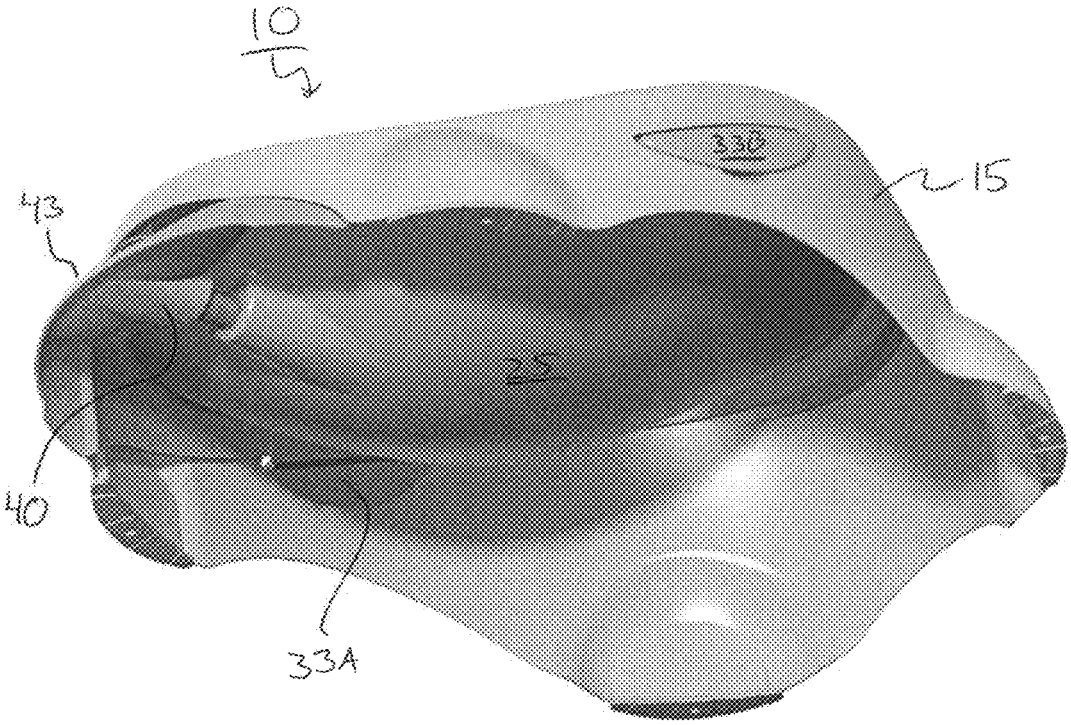
FIG. 22 is a bottom perspective view of the infant bather.
Figure 23:
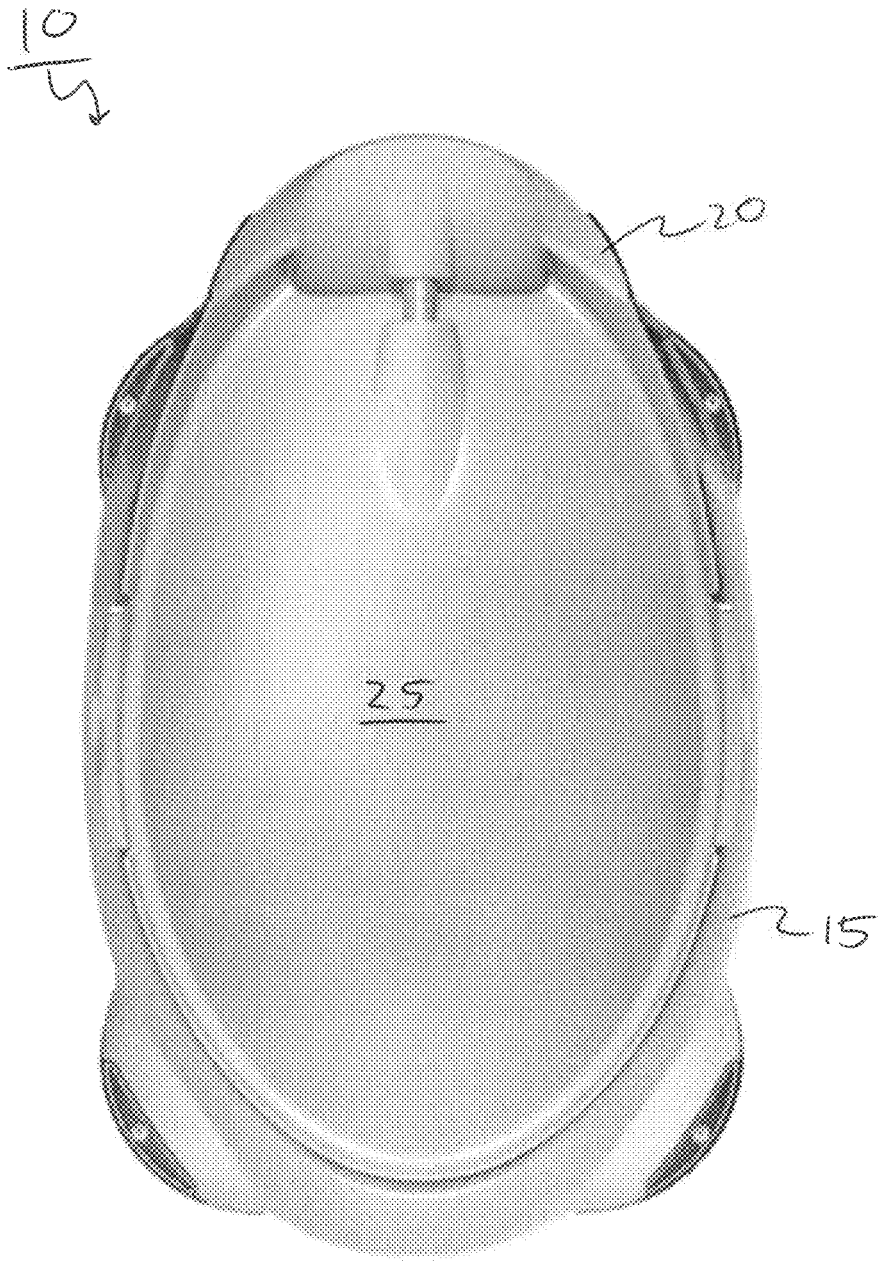
FIG. 23 is a bottom plan view of the infant bather.
Figure 24:
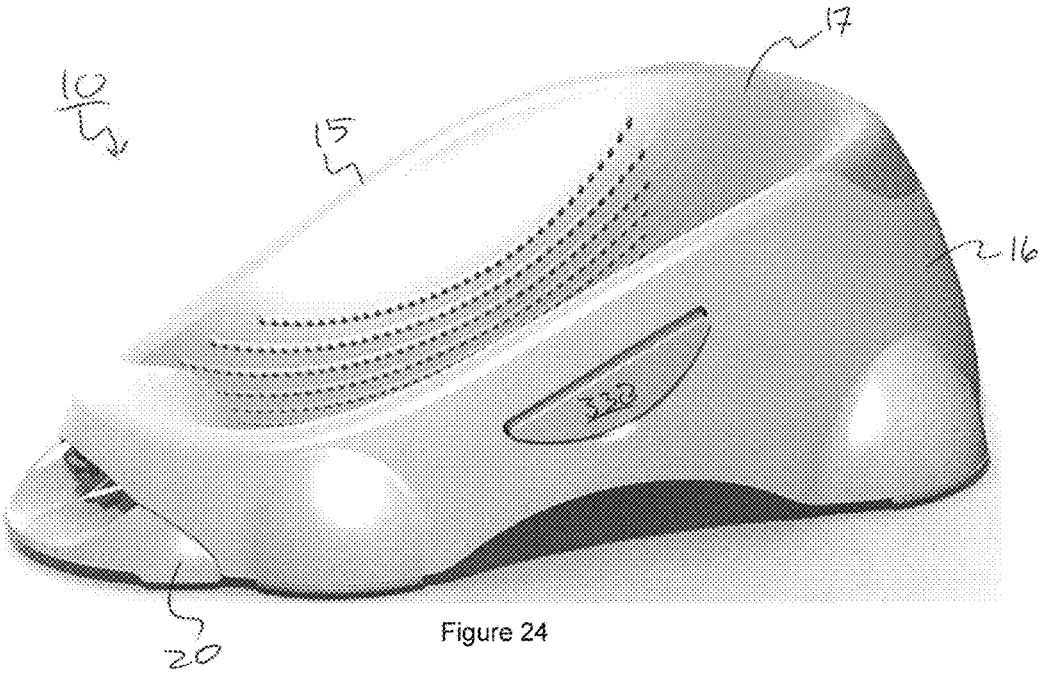
FIGS. 24-27 illustrate various side perspective views of the infant bather.
Figure 25:
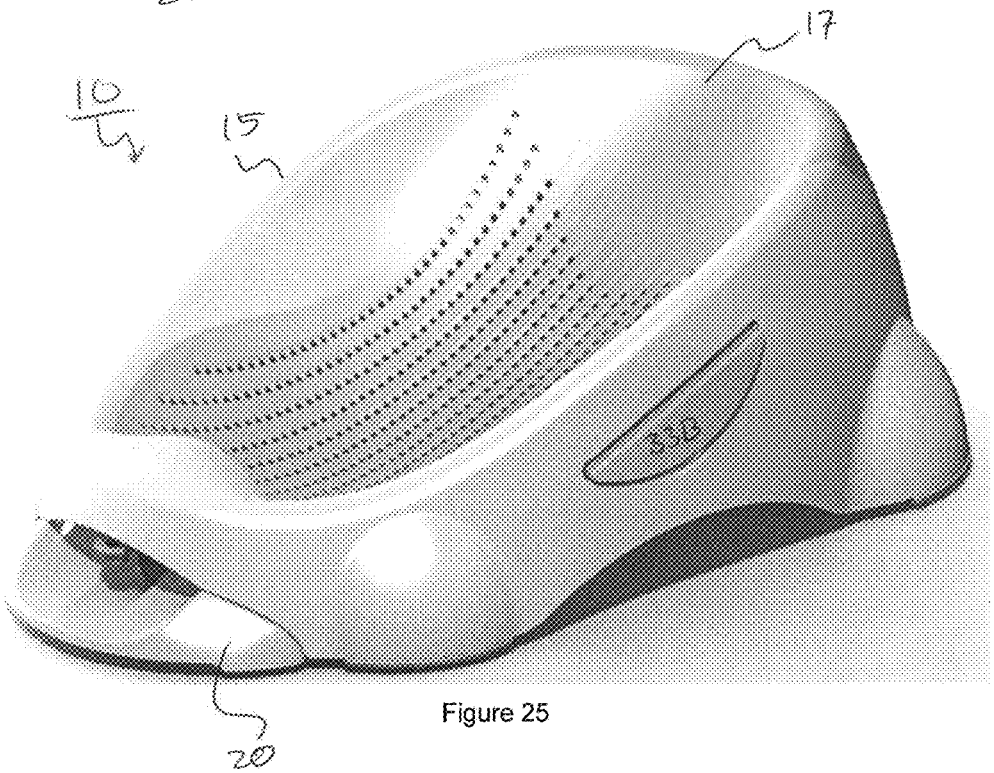
Figure 26:
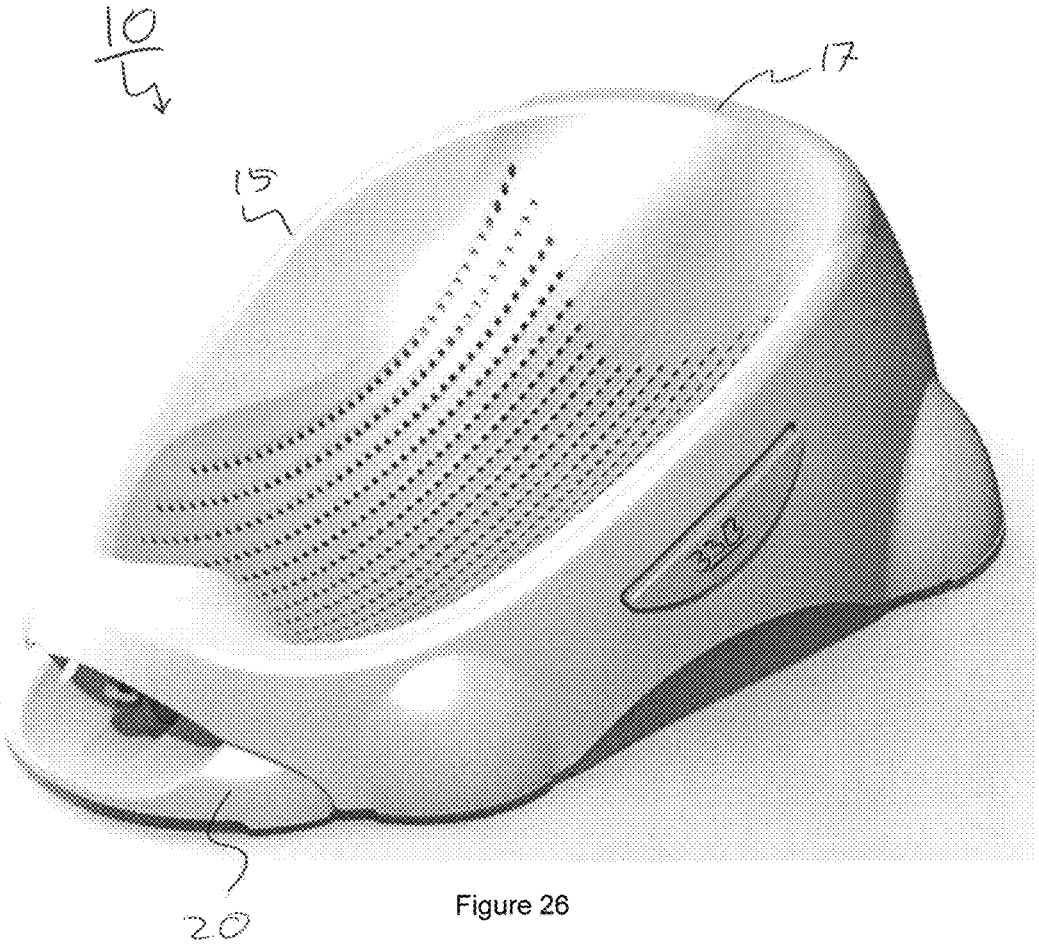
Figure 27:
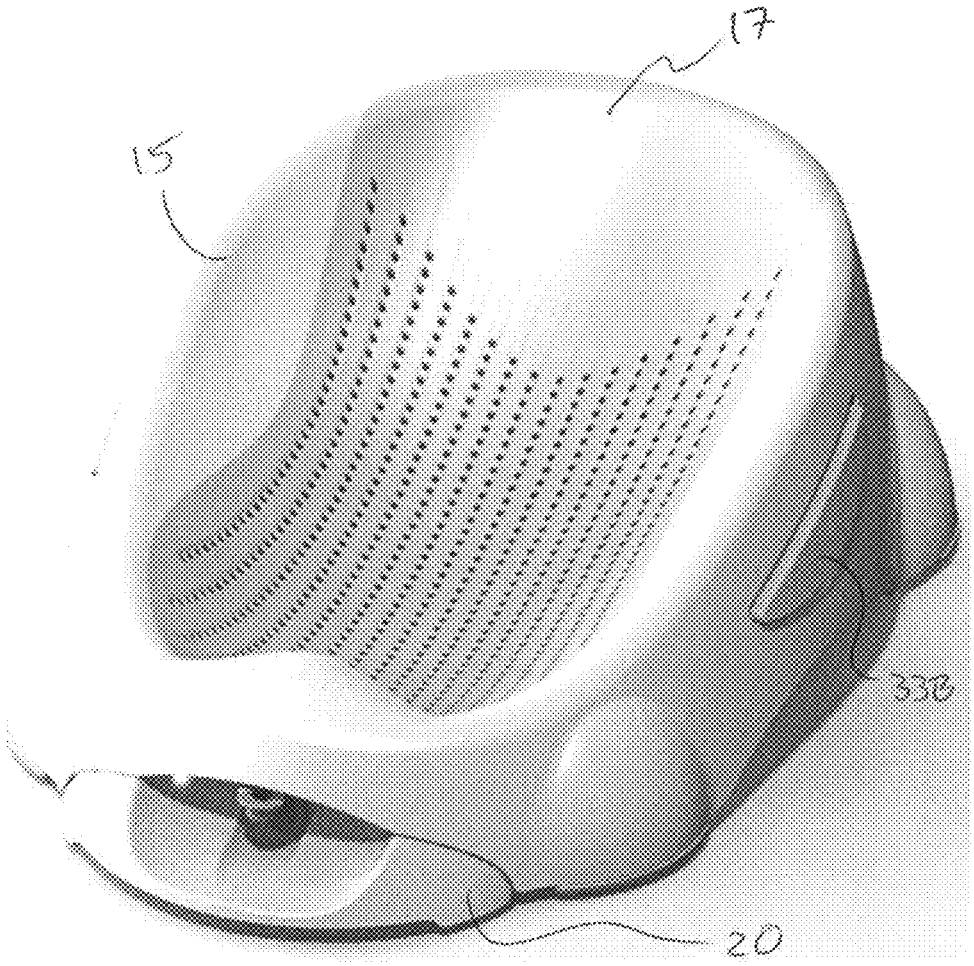

FIG. 13-14 show a cross-section view of the bather (10). FIG. 13 illustrates the cradle (17) has a first surface (17A) and an opposite second surface (17B) which have the first concave curvature adapted to receive an infant. As shown, the basin (25) has an interior surface (25A) and an exterior surface (25B) having the second concave curvature. The second surface (17B) of the cradle coincides with the interior surface (25A) of the basin (25) such that the fluid held within the basin submerges a portion of both the first and second surfaces (17A, 17B) of the cradle (17).

FIG. 14 depicts the overflow point (42) which defines the fluid threshold (37). The bather (10) discloses a method for safely bathing an infant in an infant bather (10) as previously described. A user may place an infant within the cradle (17) and proceed to supply bath water to clean the infant. As shown, when the user fills the bather (10) with fluid, the fluid will accumulate in both the cradle (17) and the basin (25). At first, the fluid drains from the cradle (17) through the at least one aperture (19) into the basin (25). As fluid accumulates in the basin (25), the bath water level rises above the lowest portion (18) of the cradle (17). Once the bath water level reaches the fluid threshold (37), fluid is displaced and drains across the overflow point (42) to maintain a constant fluid level. The user may then selectively open the plug (27) to open the corresponding basin opening (28) and drain the remaining fluid within the basin (25). The user may then remove the bottom housing (20) from the top housing (15) to clean and store the infant bather (10).

FIG. 14 also shows a ridge (54) defined on a back portion of the cradle (17). The ridge (54) projects inward towards the infant bather (10) to define a platform. The ridge (54) provides support to a back portion (51) of the bottom housing (20) when secured to the top housing (15). While the bottom housing (20) is secured to the top housing (15), the back portion (51) may rest upon the ridge (54) which then additionally supports the weight of any fluid contained within the basin (25).

Figure 28:
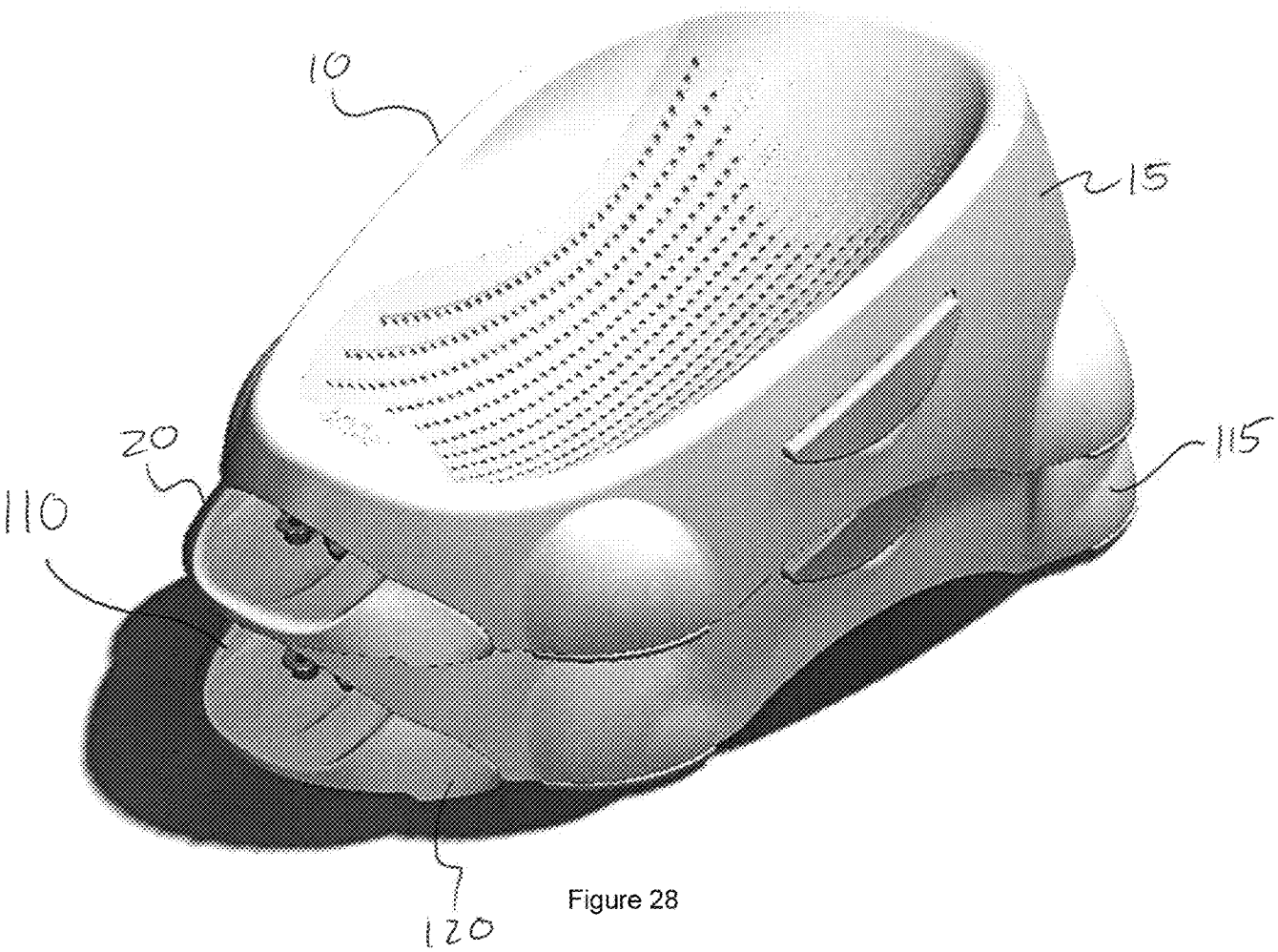
FIG. 28 depicts a side perspective view of two infant bathers stacked on one another.
Figure 29:
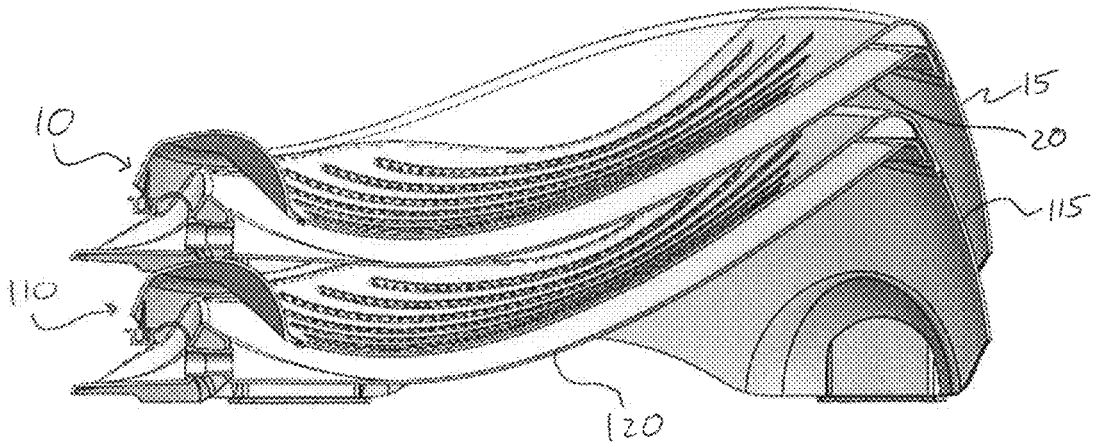
FIGS. 29-31 show side cross section views of two infant bathers stacked on one another.
Figure 30:
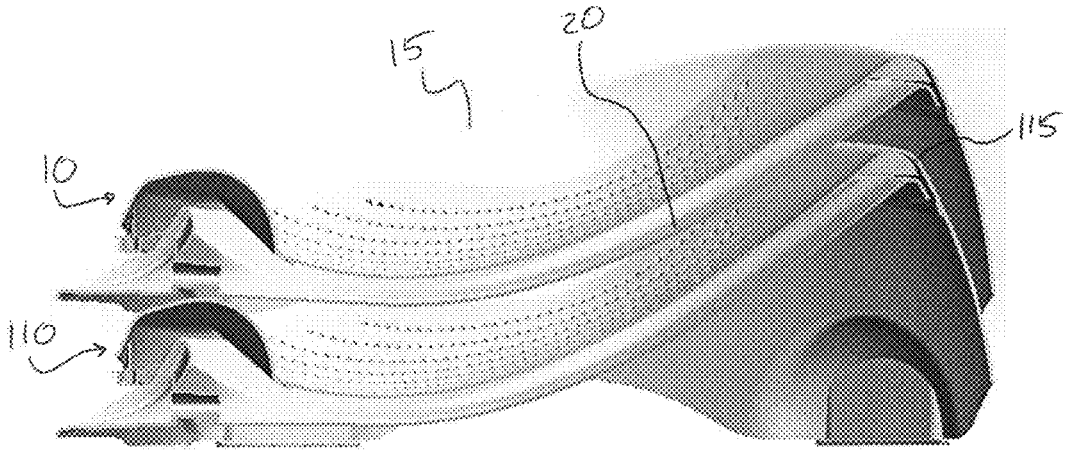
Figure 31:
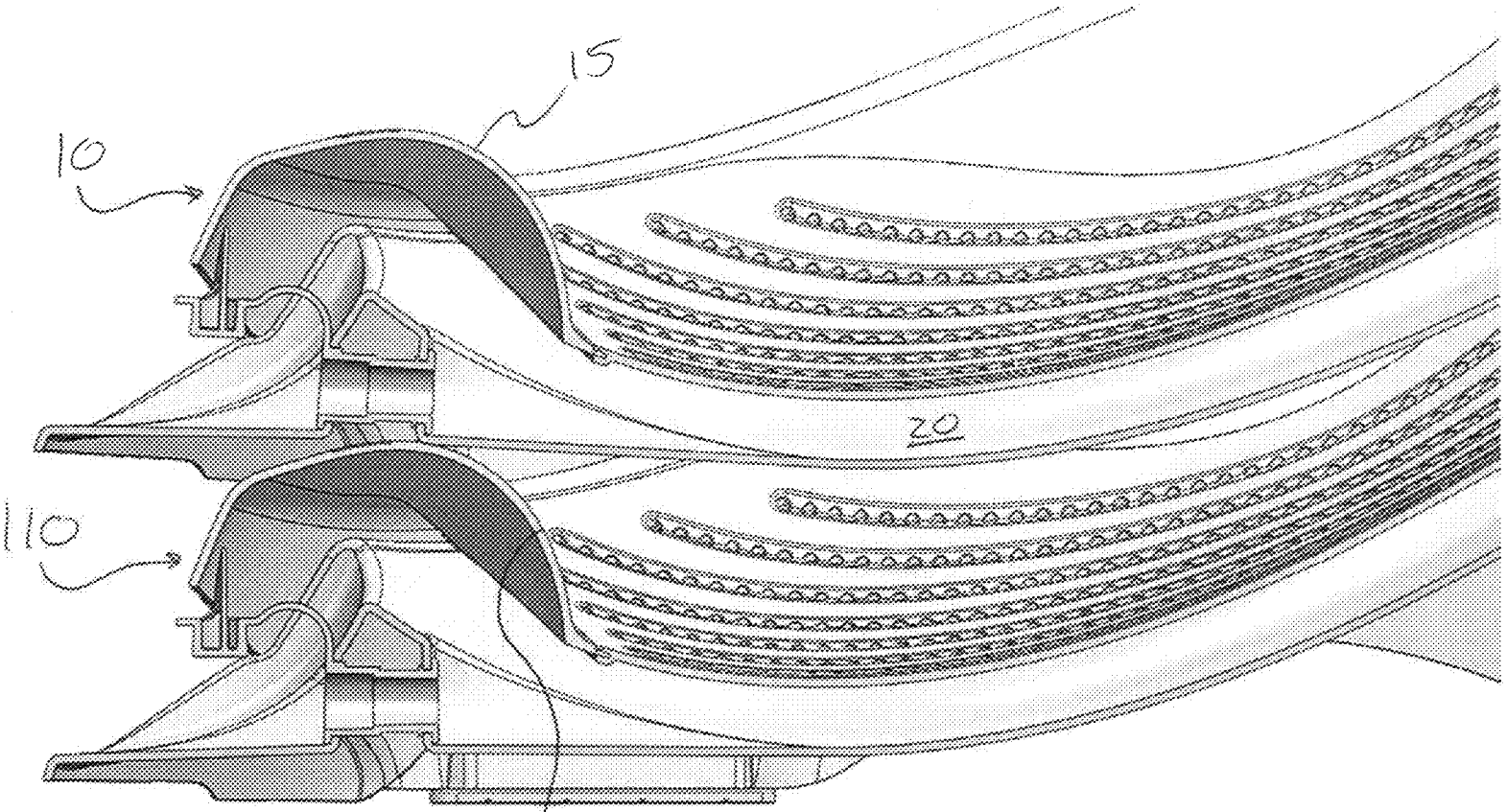

FIGS. 28-31 depict the bather (10) stacking with a second infant bather (110). The contour of the housing (15, 20) allows for a top housing (115) of the second bather (110) to fit into the space below housing (20) of the bather (10). The cross sections shown in FIGS. 29-31 more clearly illustrate how the contours align. In the configuration as shown in FIG. 28, the two bathers (10, 110) are arranged in such a way that the first bather (10) is secured on top of the second bather (110). Stacking bathers allows for decreasing the total volume of shipping multiple bathers as the total height of the stack is significantly smaller than the sum of the individual heights of each bather.

The details of the description noted above provide an overview of the engineering present in the bather disclosed herein. Terms in this detailed description are intended to be used in their broadest plain meaning. The features described above are also useful in bathers dimensioned for children or even adults requiring baths in a reclining position. The use of terms such as "baby" and "infant" are not limiting of the invention in any way.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

What is claimed:

1. An infant bather, comprising:

a top housing having an upper circumferential border; the top housing further having a cradle, disposed interior of the upper circumferential border of the top housing, with a first surface and a second surface, the cradle defining at least one aperture allowing a fluid to flow between the first surface of the cradle and the second surface of the cradle through the at least one aperture; and a bottom housing detachably secured to the top housing wherein the upper circumferential border of the top housing is adjacent to an upper circumferential border of the bottom housing; the bottom housing further having a basin with an interior surface and exterior surface; wherein the detachably secured bottom housing further comprises at least one flexible tab that mates with at least one side opening of the top housing;

wherein the second surface of the cradle coincides with the interior surface of the basin such that the fluid held within the basin submerges a portion of both the first and second surfaces of the cradle.

2. The infant bather recited in claim 1, wherein the first and second surfaces of the cradle have a first concave curvature adapted to receive an infant.

3. The infant bather recited in claim 2, wherein the interior surface of the basin has a second concave curvature adapted to retain the fluid, the first concave curvature being congruent to the second concave curvature.

4. The infant bather recited in claim 1, wherein deflecting the at least one flexible tab in a first direction releases the top and bottom housings from engagement.

5. The infant bather recited in claim 1, wherein the top housing further comprises a frame, the frame made from a first material and the cradle made from a second material, wherein the first material has a different hardness from the second material.

6. The infant bather recited in claim 1, wherein the cradle has a ridge upon which the bottom housing rests when the bottom housing is secured to the top housing.

7. An infant bather, comprising:

a top housing having an upper circumferential border; the top housing further having a cradle with a first curvature defining a lowest portion of the cradle, the cradle having a series of holes; wherein the cradle further defines at least one elongated channel running along a subset of the series of holes, the elongated channel adapted to direct and drain fluid from a concave volume of the cradle; and a bottom housing detachably secured to the top housing wherein the upper circumferential border of the upper housing is adjacent to an upper circumferential border of the bottom housing, the bottom housing having a basin with a second curvature defining a fluid threshold, wherein the first curvature is parallel to the second curvature such that the fluid threshold lies above the lowest portion of the cradle.

8. The infant bather recited in claim 7, wherein the first curvature defines the concave volume of the cradle adapted to receive an infant.

9. The infant bather recited in claim 8, wherein the second curvature defines a concave volume of the basin.

10. The infant bather recited in claim 9, wherein the concave volume of the basin contains a predetermined amount of fluid such that a lower portion of the cradle is submerged within the fluid.

11. The infant bather recited in claim 9, wherein the basin further comprises an overflow edge, wherein when a fluid level of the fluid disposed within the concave volume of the basin exceeds the fluid threshold, the fluid will drain across the overflow edge.

12. The infant bather recited in claim 7, wherein the basin further comprises a basin opening and a plug, the plug adapted to prevent fluid from passing through the basin opening, wherein the plug may be selectively removed to drain the basin.

13. The infant bather recited in claim 7, wherein the infant bather is stackable within a second infant bather.

14. The infant bather recited in claim 7, further comprising at least one flexible tab disposed on the bottom housing that mates with at least one side opening of the top housing, wherein deflecting the at least one flexible tab in a first direction releases the top and bottom housings from engagement.

15. The infant bather recited in claim 7, wherein the top housing further comprises a frame, the frame made from a first material and the cradle made from a second material, wherein the first material has a first hardness greater than a second hardness of the second material.

* * * * *